United States Patent [19]

Boucher

[11] Patent Number: 4,641,506

[45] Date of Patent: Feb. 10, 1987

[54] SLIDING BOLT LOCKING DEVICE

[75] Inventor: James E. Boucher, Leominster, Mass.

[73] Assignee: Hudson Lock, Inc., Hudson, Mass.

[21] Appl. No.: 721,413

[22] Filed: Apr. 9, 1985

[51] Int. Cl.[4] ..... E05B 65/06

[52] U.S. Cl. ..... 70/129; 292/153

[58] Field of Search ..... 70/134, 124, 129, 133, 70/81; 292/153

[56] References Cited

U.S. PATENT DOCUMENTS

| | | | |
|---|---|---|---|
| 2,103,989 | 12/1937 | Machinist | 292/153 |
| 3,606,775 | 9/1971 | Atkins | 70/129 |
| 3,792,071 | 3/1974 | Crepinsek | 292/153 |

*Primary Examiner*—Robert L. Wolfe

*Attorney, Agent, or Firm*—John E. Toupal; Harold G. Jarcho

[57] ABSTRACT

A locking device including a housing adapted for mounting in one part of an enclosure and defining an engagement surface means; a bolt retained by the housing and adapted for reciprocating movement therein between open and latched positions, the bolt comprising a latch portion adapted when in the latched position to engage another part of the enclosure movable relative to the one part thereof; and a key operated cylinder lock retained by and movable with the bolt during reciprocating movement thereof, the lock being rotatable between locked and unlocked positions. Also included is a locking member retained by and movable both reciprocally and rotationally with the lock and arranged to be engaged with the engagement surface means and prevent reciprocating movement of the bolt with the lock in its locked position; and to be disengaged from the engagement surface means to allow reciprocating movement of the bolt with the lock in its unlocked position.

11 Claims, 4 Drawing Figures

FIG. 1
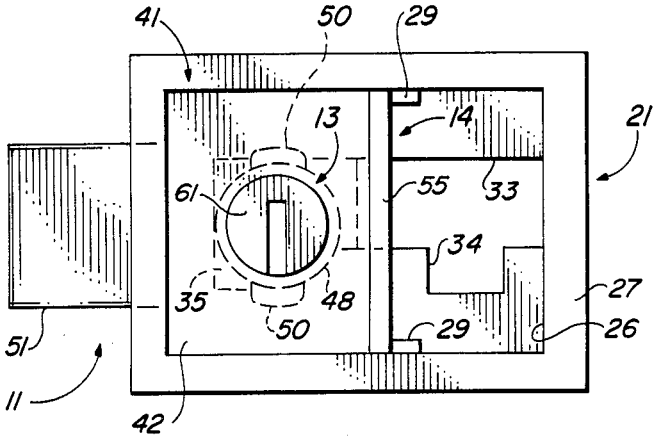
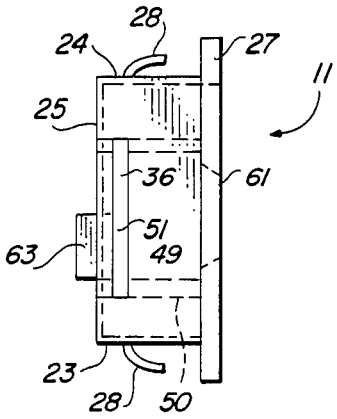
FIG. 2
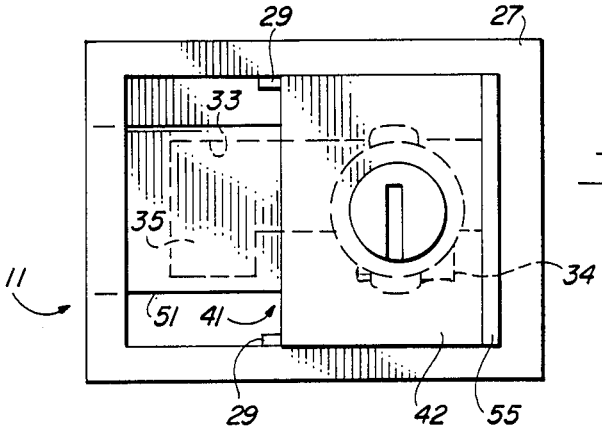
FIG. 3
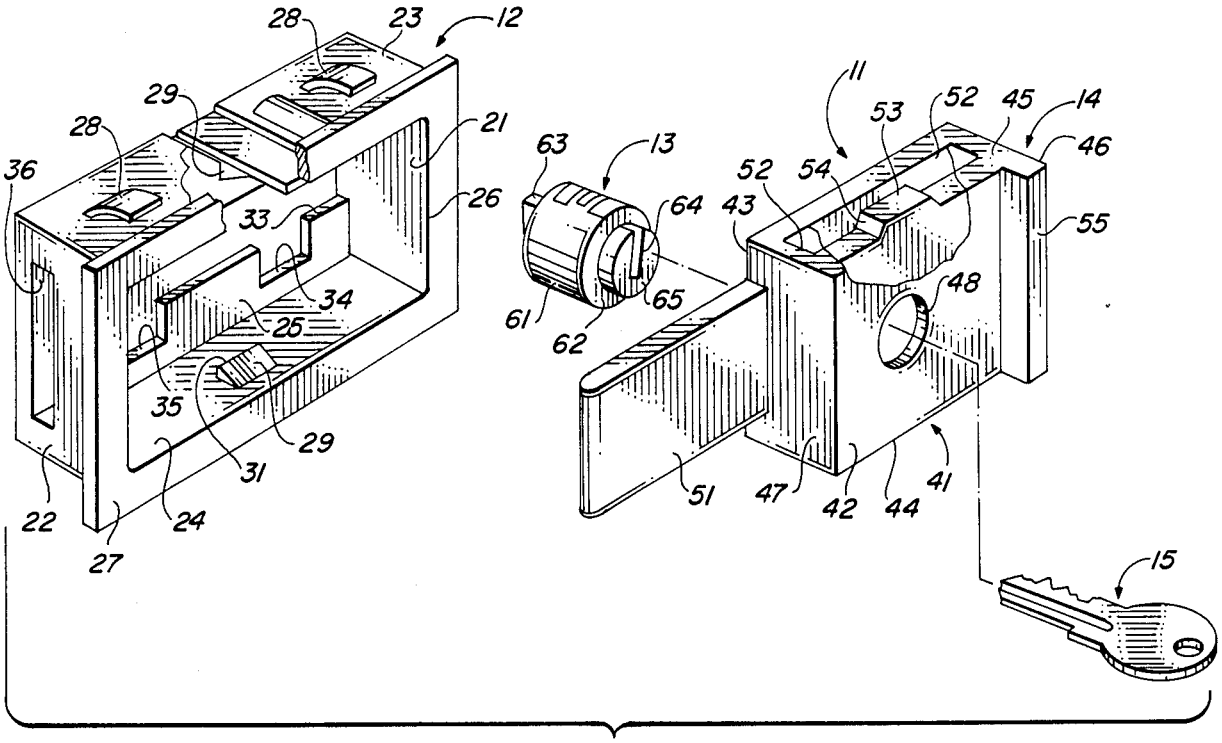
FIG. 4

SLIDING BOLT LOCKING DEVICE

BACKGROUND OF THE INVENTION

This invention relates generally to a sliding bolt locking device and, more particularly, to such a device specifically suited for use with enclosures having hinged doors.

Various kinds of locks have been devised for use with enclosures having sliding doors. Generally the lock is mounted on the hinged door and has a locking member that engages the enclosure in a locked position to prevent relative movement between the enclosure and the door. Although functionally effective, prior locks of this type have been either costly per se or costly to assemble.

The object of this invention, therefore, is to provide an improved, less expensive bolt lock for use with enclosures having hinged access doors.

SUMMARY OF THE INVENTION

The invention is a locking device including a housing adapted for mounting in one part of an enclosure and defining an engagement surface means; a bolt retained by the housing and adapted for reciprocating movement therein between open and latched positions, the bolt comprising a latch portion adapted when in the latched position to engage another part of the enclosure movable relative to the one part thereof; and a key operated cylinder lock retained by and movable with the bolt during reciprocating movement thereof, the lock being rotatable between locked and unlocked positions. Also included is a locking member retained by and movable both reciprocally and rotationally with the lock and arranged to be engaged with the engagement surface means and prevent reciprocating movement of the bolt with the lock in its locked position; and to be disengaged from the engagement surface means to allow reciprocating movement of the bolt with the lock in its unlocked position. Mounting of the lock in the sliding bolt provides an extremely compact and inexpensive locking device that can be easily assembled into an enclosure having a hinged access door.

According to one feature of the invention, the housing further comprises detents for engaging the bolt to retard movement thereof from either the said open or latched position. The detents prevent inadvertent vibration induced movement of the bolt out of its open and latched positions.

According to another feature of the invention, the engagement surface means comprises a first engagement surface engaging the locking member with the lock in its locked position and the bolt in its latched position and a second engagement surface engaging the locking member with the lock in its locked position and the bolt in its open position. The first and second engagement surfaces facilitate locking of the bolt in either its open or latched position.

According to yet another feature of the invention, the locking member extends eccentrically from a rear surface of the lock, the housing further comprises a rear wall defining a longitudinal slot that receives and accommodates reciprocating movement of the locking member with the lock in its unlocked position, and the first and second engagement surfaces are defined by first and second locking slots extending from the longitudinal slot in a direction transverse to the reciprocating movement of the bolt. This arrangement provides the desired functions in an extremely simple form.

According to further features of the invention, a pair of longitudinal retainer ribs extend from opposite side walls of the housing, the bolt comprises side surfaces that define longitudinal grooves that receive the retainer ribs, the detents comprise transverse ribs extending from the housing's side walls, the bolt side surfaces define transverse grooves that receive the transverse ribs slots with the bolt in its latched and open positions, and both the housing and the bolt are integral units molded from a flexible plastic. This arrangement simplifies assembly by permitting press fitting of the bolt into the housing.

DESCRIPTION OF THE DRAWINGS

These and other objects and features of the invention will become more apparent upon a perusal of the following description taken in conjunction with the accompanying drawings wherein:

FIG. 1 is a schematic plan view of the invention shown in a latched position;

FIG. 2 is a schematic side view of the device shown in FIG. 1;

FIG. 3 is a schematic plan view of the invention shown in an open position; and FIG. 4 is an exploded isometric view of the device shown in FIGS. 1–3.

DESCRIPTION OF THE PREFERRED EMBODIMENT

Illustrated in FIGS. 1–4 is a locking device 11 including a housing 12, a sliding bolt 14 and a cylinder lock 13. The cylinder lock 13 is retained by the sliding bolt 14 which in turn is mounted for reciprocating movement in the housing 12. As shown in FIG. 4, the cylinder lock 13 is operated by a key 15.

The housing 12 includes end walls 21, 22; side walls 23, 24 and a rear wall 25 that together define a rectangular cavity. Opposite to the rear wall 25 is a frontal opening 26 bordered by an outwardly extending flange 27. A pair of spaced apart, flexible ears 28 extend from the outer surface of each of the side walls 23, 24. Extending from inner surfaces of each of the side walls 23, 24 is a longitudinally oriented, triangularly shaped detent rib 29. The rib 29 has rounded corners 31. Formed in the rear wall 25 is a longitudinally oriented slot 33 while extending transversely therefrom is a first engagement slot 34 and a second engagement slot 35. A bolt opening 36 is formed in the end wall 22.

The bolt 14 includes a base portion 41 having a front surface 42, a rear surface 43, side surfaces 44, 45 and end surfaces 46, 47. Extending between the front and rear surfaces 42, 43 is a stepped cylindrical bore 48 that defines an internal shoulder 49. Also formed in the base portion 41 are diametrically spaced apart splines 50 intersecting and parallel to the bore 48. A latching tab portion 51 of the bolt 14 extends longitudinally from the end surface 47 of the base 41. Formed in each of the side surfaces 44, 45 is a longitudinal groove 52 with a centrally located detent tab 53 having inclined side walls 54. A handle portion 55 of the bolt 14 extends outwardly from the front surface 42 of the base portion 41 adjacent to the end surface 46.

The lock 13 comprises a plug 61 rotatably mounted in the cylindrical bore and having a shoulder 62. Retained by a rear end of the plug 61 and movable therewith is an eccentric locking member 63. The locking member 63 extends radially of the plug 61 so as to move in an arc during rotational movement thereof. Opening into a front face 65 of the plug 61 is a keyway 64 that receives the key 15. The plug 61 is a keyway 64 that receives the key 15. The plug 61 is conventional and has key operated wafers that are received by the splines 50 in the base portion 41.

During assembly, the plug 61 is inserted into the bore 48 through the opening in the rear surface 43 of the base portion 41. Axial positioning of the plug 61 and retention thereof within the bore 48 is provided by engagement between the shoulder 62 on the plug 61 and the internal shoulder 49. The tab portion 51 of the bolt 14 is then inserted through the bolt opening 36 in the end wall 22 until a relative position is reached wherein the base portion 41 can be forced into the cavity defined by the housing 12. During this assembly step, the inner portions of the end walls 44, 45 must be forcibly pressed over the retainer ribs 29 which are spaced apart by a distance slightly less than the spacing between the end walls 44, 45. This procedure is facilitated by integrally molding both the bolt 14 and the housing 12 of a suitable resilient thermo-plastic such as Valox marketed by the General Electric Company.

Once the base portion 41 of the bolt 14 is in position within the housing 12, the retainer ribs 29 reside in the longitudinal grooves 52 and serve to both retain and guide longitudinal reciprocating motion of the bolt 14. During such movement, the detent ribs 29 contact and must be forced by the detent tabs 53 into positions on opposite sides thereof. In those positions, the inclined side walls 54 remain engaged with the detent rib 29. Thus, the detent ribs 29 and the detent tabs 53 establish predetermined positions from which movement of the bolt 14 is retarded.

OPERATION

After assembly of the locking device 11, the housing 12 is press fitted into a suitably sized opening in a hinged door of an enclosure (not shown). During this operation, the ears 28 are compressed by the edges of the opening in the door and then engage the inner surfaces thereof to retain the housing 12. With the device 11 in the latched position shown in FIG. 1, the bolt tab portion 51 extends through the bolt opening 36 and engages a suitably positioned recess in the enclosure to thereby prevent movement of its hinged door. Also, the plug 61 is in a locked position with the locking member 63 within the second transverse slot 35 and engaged by an inner, transverse edge thereof to prevent opening longitudinal movement of the bolt 14.

When access to the enclosure is desired, a proper key 15 is inserted into the keyway 64 and the plug 61 is rotated 180° clockwise to rotate the locking member 63 out of the second transverse slot 35 and into the longitudinal slot 33. The handle portion 55 can then be gripped and used to longitudinally move the bolt 14 into the open position shown in FIG. 3 wherein the tab portion 51 is withdrawn into the housing 12 to permit relative movement between the enclosure and its hinged door. During this movement of the bolt 14, corresponding movement of the retained locking member 63 is accommodated by the longitudinal slot 33.

Once the open position of the bolt 14 is obtained, the plug 61 can be rotated 180° clockwise and the key 15 removed. That movement of the plug 61 into its locked position rotates the locking member 63 into the first transverse slot 34 and into engagement with an inner, transverse edge thereof to thereby prevent closing longitudinal movement of the bolt 14. Thus, the bolt 14 can be locked in either the latched position of FIG. 1 or the open position of FIG. 3. In the open position one inclined wall 54 of each detent tab 53 is engaged by the detent ribs 29 to retard longitudinal movement of the bolt 14. Similarly, movement of the bolt 14 from the latched position of FIG. 1 is retarded by engagement between the detent ribs 29 and opposite inclined walls 54 of the detent tabs 53. Thus, even with the plug 61 in its unlocked position, the bolt 14 is retained in either its latched or open position in the absence of an applied force on the handle portion 55 sufficient to overcome the friction provided by engagement between the detent ribs 29 and the detent tabs 53.

Obviously, many modifications and variations of the present invention are possible in light of the above teachings. It is to be understood, therefore, that the invention can be practiced otherwise than as specifically described.

What is claimed is:

1. A locking device comprising:

housing means adapted for mounting in one part of an enclosure so as to be fixed to and immovable with respect thereto, said housing defining first and second engagement surfaces;

bolt means retained by said housing means and adapted for reciprocating movement therein between open and latched positions; said bolt means comprising a latch portion adapted when in said latched position to engage another part of the enclosure movable relative to the one part thereof;

a key operated cylinder lock retained by and movable with said bolt means during said reciprocating movement, said lock being rotatable between locked and unlocked positions; and a locking member retained by and movable both reciprocally and rotationally with said lock and adapted to be engaged with said first and second engagement surfaces and prevent said reciprocating movement of said bolt means with said lock in said locked position; and to be disengaged from said first and second engagement surfaces to allow said reciprocating movement of said bolt means with said lock in said unlocked position and wherein said first engagement surface engages said locking member with said lock in said locked position and said bolt means in said latched position and said second engagement surface engages said locking member with said lock in said locked position and said bolt in said open position.

2. A locking device according to claim 1 wherein said housing means comprises retainer means retaining said bolt means and allowing said reciprocating movement thereof.

3. A locking device according to claim 2 wherein said housing means further comprises detent means for engaging said bolt means to retard movement thereof from said open and latched positions.

4. A locking device according to claim 2 wherein an outer end of said lock defines a keyway, said locking member extends eccentrically from a rear surface of said lock, said housing means further comprises a rear wall defining a longitudinal slot that receives and accommodates reciprocating movement of said locking member with said lock in said unlocked position, and said engagement surface means is defined by locking slot means extending from said longitudinal slot in a direction transverse to said reciprocating movement.

5. A locking device according to claim 4 wherein said locking slot means comprises a pair of longitudinally spaced apart transverse slots each defining one of said engagement surfaces.

6. A locking device according to claim 5 wherein said housing means further comprises detent means for engaging said bolt means to retard movement thereof from said open and latched positions.

7. A locking device according to claim 6 wherein said retainer means comprise a pair of longitudinal ribs extending from opposite side walls of said housing, and said bolt comprises side surfaces that define longitudinal grooves that receive said ribs.

8. A locking device according to claim 7 wherein said detent means comprise tabs in said longitudinal grooves, said tabs having side walls that engage side walls of said ribs with said bolt in said latched and open positions.

9. A locking device according to claim 8 wherein said housing means and said bolt means are integral units each molded from a flexible plastic, and during assembly into said housing said bolt means is adapted to be press fitted by said longitudinal ribs so as to provide registration thereof with said longitudinal grooves.

10. A locking device according to claim 9 wherein said bolt means further defines a handle portion extending out of said housing means.

11. A locking device according to claim 10 wherein said housing means comprises an end wall that defines a bolt opening for accommodating said reciprocating movement of said bolt means.

* * * * *